United States Patent [19]

McGrath et al.

[11] 4,133,302

[45] Jan. 9, 1979

[54] INFANT INCUBATOR

[75] Inventors: John A. McGrath, Mooroolbark; Murray R. Robertson, Reservoir, both of Australia

[73] Assignee: The Commonwealth Industrial Gases Limited, Australia

[21] Appl. No.: 792,372

[22] Filed: Apr. 29, 1977

[30] Foreign Application Priority Data

Apr. 30, 1976 [AU] Australia ..... PC5755

[51] Int. Cl.[2] ..... A61G 11/00

[52] U.S. Cl. ..... 128/1 B

[58] Field of Search ..... 128/1 B

[56] References Cited

U.S. PATENT DOCUMENTS

| | | | |
|---|---|---|---|
| 2,633,842 | 4/1953 | Higgs | 128/1 B |
| 3,005,673 | 10/1961 | Smith et al. | 128/1 B |
| 3,076,451 | 2/1963 | Stoner | 128/1 B |
| 3,187,744 | 6/1965 | Dorsak et al. | 128/1 B |
| 3,527,220 | 9/1970 | Summers | 128/260 |

*Primary Examiner*—William E. Kamm

*Attorney, Agent, or Firm*—Beveridge, De Grandi, Kline & Lunsford

[57] ABSTRACT

An infant incubator. A substantially rectangular patient support tray forms the floor of an occupant compartment. A substantially rectangular plate is disposed beneath the tray to define therewith a return flow path for taking atmosphere from the compartment from opposite longitudinal edges of the compartment floor. A base is provided beneath the plate to define therewith a delivery path for supplying atmosphere to the compartment at opposite transverse edges of the compartment floor. The base includes a heater to heat the atmosphere flowing over the base under the action of a centrally located impeller indirectly coupled to a motor located beneath the base. Humidifying means can also be provided.

12 Claims, 7 Drawing Figures

FIG 2

INFANT INCUBATOR

This invention relates to infant incubators of the kind comprising an enclosed occupant space, and means to maintain a life-supporting atmosphere within said space.

Conventional design dictates the use of a heavy cast aluminum base to provide a "heat-sink" (with inherent high heat losses) to even out temperature fluctuations within the incubator. Such bases have given little design freedom and are subject to high manufacturing costs because of the complexity of the bases themselves and the mounting arrangements therefor.

In other prior art incubators, base structures are used which comprise a series of chambers through which the atmosphere is caused to circulate, these chambers are difficult to clean and sterilize effectively. They include coiled electrical resistance heating elements housed in one of the chambers and energised by the main voltage supply. These heating elements produce high surface temperatures, but such high temperatures are to be avoided as possibly dangerous; for example, if ether vapour is present it may decompose to form formaldehyde which is toxic.

Circulation of atmosphere is conventionally provided by a fan driven directly by an electric motor housed in a chamber adjacent to the fan chamber, the drive is effected by a drive shaft which extends through a dividing wall. This calls for efficient sealing of the drive shaft relative to the aperture in the dividing wall, as the incubator atmosphere may contain a high percentage of oxygen making it important that it be kept from areas of possible ignition (the fan motor vicinity, for example) and as well from areas of contamination by lubricants and the like.

An object of the present invention or its preferred embodiments is to reduce some or all of the above-stated shortcomings.

According to the invention there is provided an infant incubator comprising a patient support tray forming the floor of an occupant compartment, a plate disposed beneath said support tray and defining therewith a return flow path for taking atmosphere from said compartment, a base beneath said plate defining therewith an atmosphere delivery path communicating with said return flow path, impeller means to withdraw atmosphere from said compartment through said return flow path for delivery along said delivery path back to said compartment, heater means arranged in heat transfer relationship to atmosphere, proceding to said compartment and means for adding make-up atmosphere to the atmosphere proceding to said compartment.

Preferably, the incubator includes fan drive means incorporating a magnetic coupling for the said fan such that no drive shaft penetrates the base of the incubator.

Preferably, the incubator further provides means to enable humidification of the life supporting atmosphere.

A preferred embodiment of the invention will now be described, by way of example only, with reference to the accompanying drawings in which.

Figure 1:
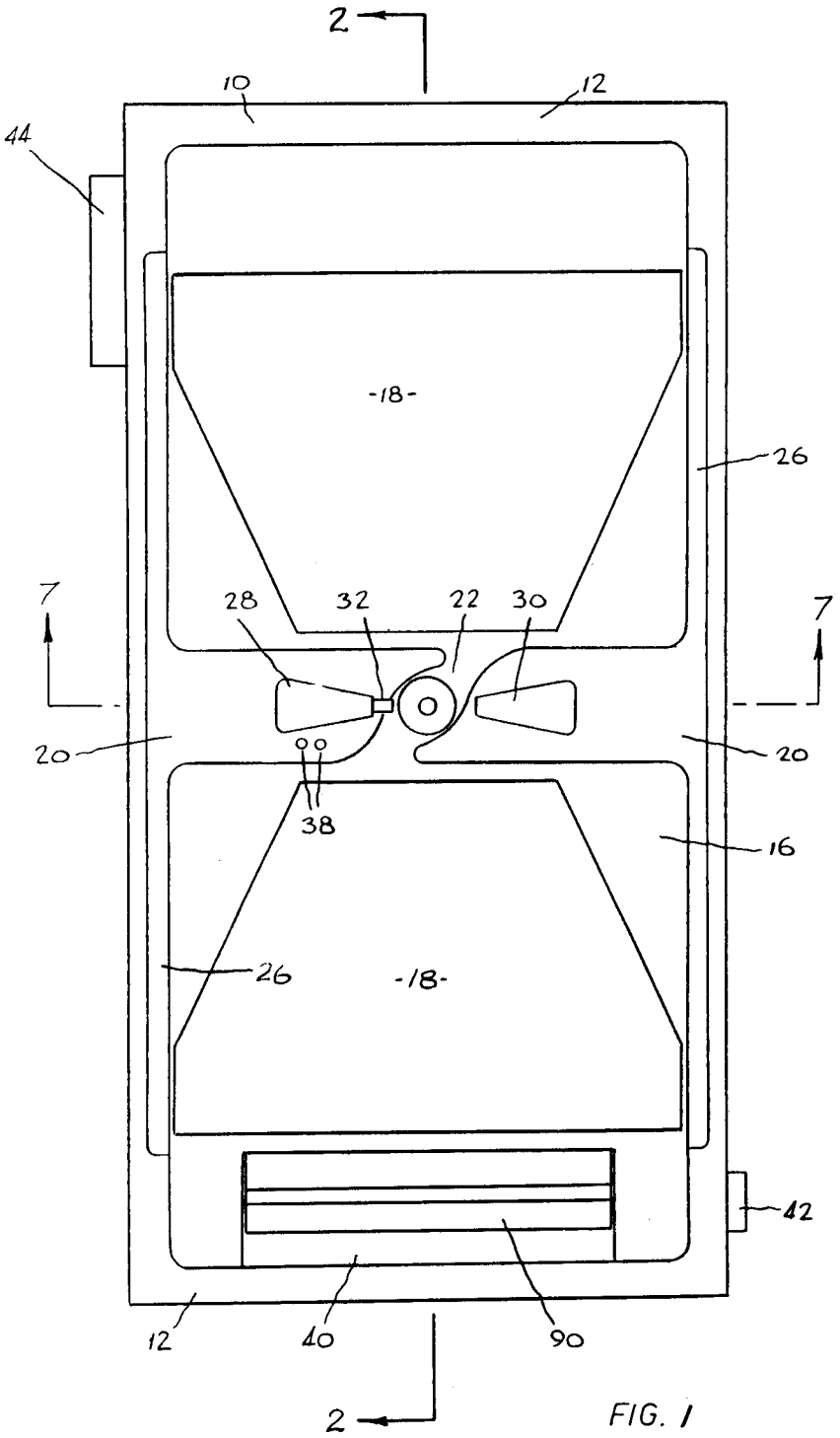
FIG. 1 is a plan view of the upper surface of the base of an infant incubator of the present invention.
Figure 2:
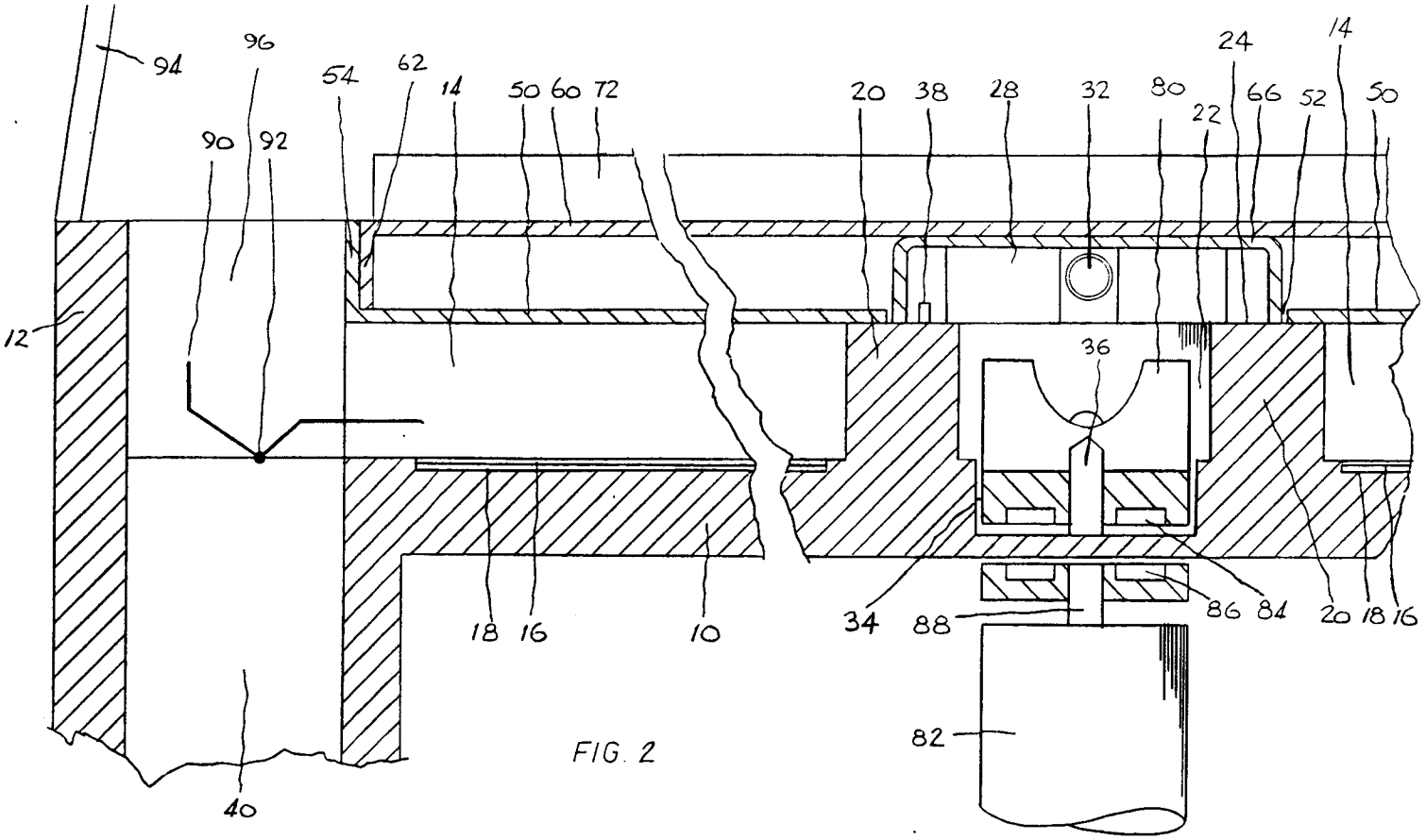
FIG. 2 is a view taken along part of the line 2—2 of FIG. 1; (on a larger scale)

In FIGS. 1 and 2 a base is shown generally by numeral 10 which is preferably made by moulding such as, for example, from a rigid polyurethane integral skin foam conforming to Specification UL 94V-0 for fire retardancy. Besides offering economy in production, this material also has the advantages of wide design scope with high material strength, low weight and excellent resistance to water.

Base 10 has an upstanding wall 12 which forms part of a pair of wells 14, the bottom surface 16 of which has the heater or heaters 18 housed therein. These are preferably of the "printed circuit" type. The surfaces of the wells 14 are treated with a two part expoxy coating or the like which provides a hard wearing and decorative unbroken surface which can easily be cleaned and sterilized.

The wells 14 are separated by a wall 20 which has an air flow passage 22 formed generally midway of its length. Wall 20 rises from surface 16 to a level 24 which coincides with the depth of recesses 26 formed in the longitudinal sides of the wells 14.

Formed on the top surfaces of wall sections 20 are raised bosses 28 and 30. Boss 28 includes air outlet 32 whilst boss 30 serves as locating piece as will be described later.

Located centrally of air passage 22 is a recess 34 with a central spigot 36. Temperature sensing elements are shown at 38.

At the end of one well 14 is located water reservoir 40. Water supply and level indicating means for the reservoir 40 is mounted on the front of base 10 at 42.

Indicated generally at 44 is the entry and mixing device for the air/oxygen atmosphere to the incubator.

Figures 3, 4:
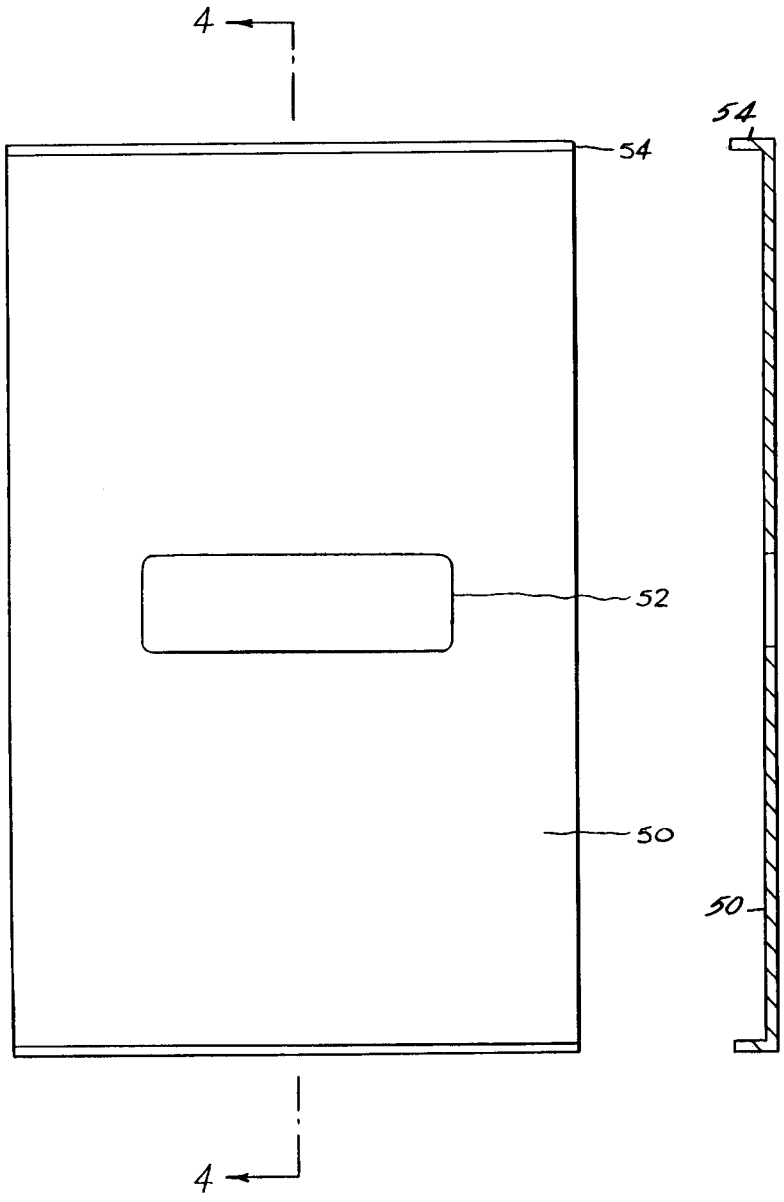
FIG. 3 is a plan view of the plate shown in section in FIG. 2.
FIG. 4 is a view taken along line 4—4 of FIG. 3.
Figure 7:
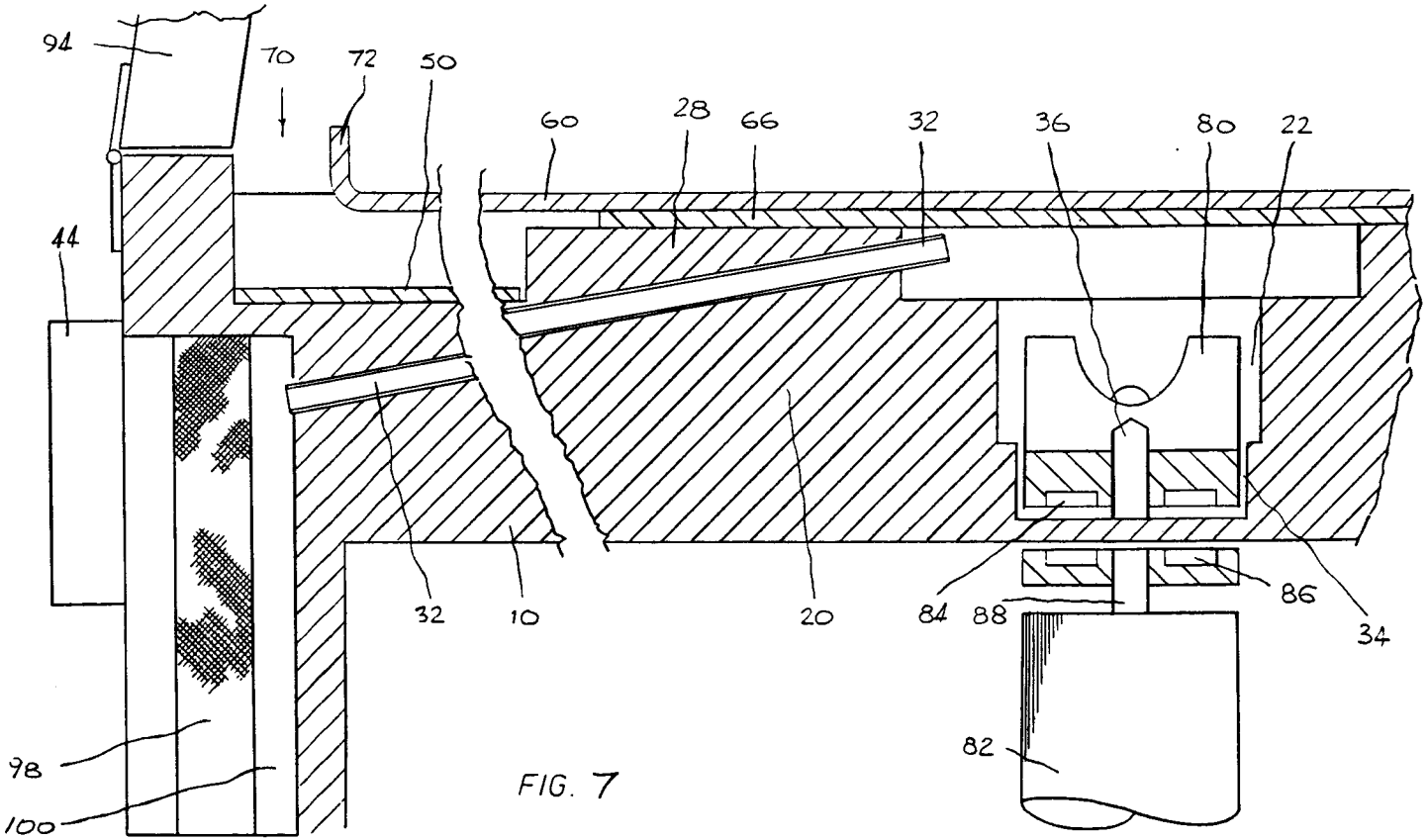
FIG. 7 is a view taken along part of line 7—7 of FIG. 1; (on a larger scale).

FIGS. 3 and 4 show a lower plate for air circulation purposes. As shown in FIGS. 2 and 7, the plate 50 is located on the base 10 and has a cut out area shown generally by perimeter line 52 wich permits plate 50 to be supported by wall 20 and recesses 26. It will be noted that plate 50 then covers that area of the well 14 housing the heating elements 18 with the exception of a major portion of air passage 22. Plate 50 has at its longitudinal extremities upturned ends 54.

Figure 5:
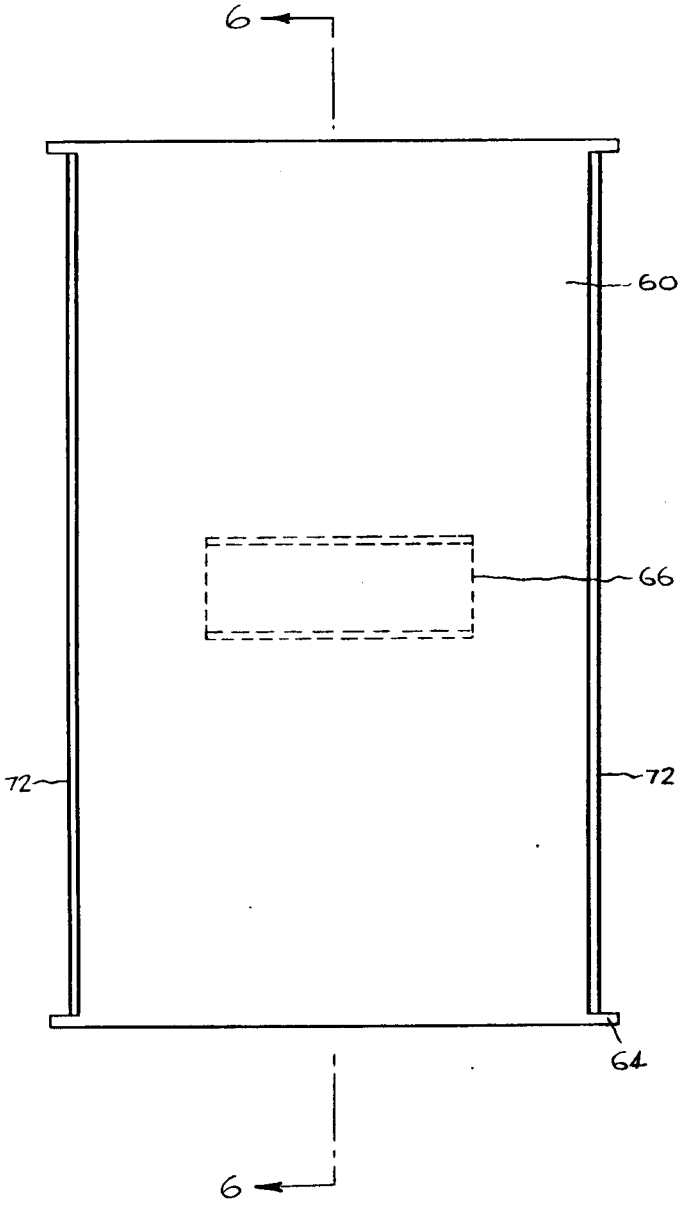
FIG. 5 is a plan view of the patient support tray shown in section in FIG. 2.
Figure 6:
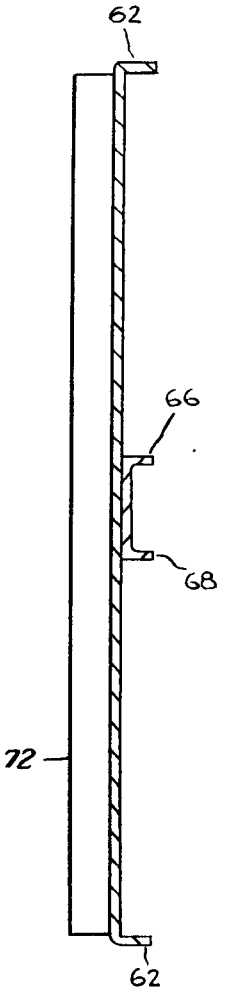
FIG. 6 is a view taken along line 6—6 of FIG. 5.

FIGS. 5 and 6 illustrate a patient support tray 60, the longitudinal extremities of which are down turned as indicated at 62. When tray 60 is placed over the plate 50, portions 62 fit within the upturned portions 54 shown in FIG. 4. The extreme ends of portions 62 indicated at 64 locate in recesses 26 of FIG. 1.

Fitted as by welding, rivetting or the like beneath tray 60 is a bridge-piece 66. When the tray 60 is in the installed position, the bridge-piece 66 locates within the cut out area 52 as shown in FIGS. 2 and 3 to bridge the raised bosses 28 and 30, thus enshrouding the supply of air/oxygen mixture being supplied through air outlet 32. Raised bosses 28 and 30 thus serve as supports for the central area of tray 60. The longitudinal edges of tray 60 are upturned thus leaving ducts between tray 60 and recesses 26 above plate 50, the ducts being indicated generally at 70. The upturned longitudinal edges shown at 72 impart rigidity to tray 60 on top of which a mattress usually locates for the comfort of the occupant.

FIG. 7 shows a fan 80 located in recess 34 fitted to rotate about central spigot 36. The bearing surface between spigot 36 and dynamically balanced fan 80 is of the self-lubricating type which allows the fan to run for long periods without noise generation.

The driving force for fan 80 is supplied by a magnetic coupling between the fan and an electrically driven motor located beneath base 10. The motor indicated at 82 may be for example a 16 volt four pole induction motor. The magnetic coupling for propulsion of fan 80 is provided by two similar permanent magnets one of which is located in the base of fan 80 indicated by numeral 84, and the other located as at 86 attached to the shaft 88 of motor 82. On rotation of shaft 88 and magnet 86, the existing magnetic field causes magnet 84 to rotate, thus propelling the fan at a speed equivalent to motor 82.

FIG. 2 indicates base 10 containing water reservoir 40 with plate 50 and tray 60 in position, with a butterfly valve 90 installed above the water level of reservoir 40 and hinged as at 92. A control lever or the like (not shown) is located at the front of base 10 and connects to butterfly valve 90, (which extends to the full length of reservoir 40 (as shown in FIG. 1). The butterfly valve is easily removable for autoclaving for sterilization. The incubator is fitted with a canopy 94 as in known apparatus of this kind.

An electronics module is preferably fitted into a formed recess in the central front of base 10 for control of the incubator temperature and for the servo control of the temperature of the occupant of the incubator. Preferably, the module will be of the "cassette" conception so that it allows quick and simple replacement should a unit be considered faulty.

Likewise, the base as illustrated is of a relatively inexpensive construction such that in the unlikely event of failure of the moulding or of the integrated "printed circuit board" heaters, the base may readily be replaced.

The heaters are preferably of copper on an epoxy/-glass board. They are run on low voltage, i.e., 30 volts maximum, and have a high surface area for low temperature operation, for safety, and to obviate the problem of pyrolysis formation of formaldehyde from ether.

Air/oxygen atmosphere for breathing is introduced at the rear of the unit via a mixing device mounted on the base 10. Preferably a fine control of oxygen concentration is achieved by the injector principle of entraining additional air and a device to give warning of oxygen supply failure is incorporated.

Plate 50 and 60 may be of metal or plastics material suitable for sterilizing.

With the canopy closed, air/oxygen atmosphere is entrained via device 44 and passed through a two layer, large surface area bacterial filter 98 into a gallery 100 in the rear of the unit base 10. The gallery and filter extends for substantially the entire length of the base. From the gallery the atmosphere is drawn through an unrestricted pipe to outlet 32 and into the tunnel formed by bridge piece 66 where the atmosphere meets the blades of rotating fan 80. At this point, the atmosphere divides into two flows from the periphery of the fan and travels through air passage 22, thus passing along the underside of plate 50 until it emerges through delivery ducts 96 at the end of each well 14 and circulates upwardly over the inner walls of the canopy.

As the space between plate 50 and tray 60 is in communication with air passage 22, the atmosphere between the plate and tray is entrained by the flow from the fan into the space below plate 50. Atmosphere from within the canopy flows into the space between plate 50 and tray 60 via return ducts 70 along the longitudinal edges of tray 60 and is thus recirculated. During the circulation beneath plate 50 the atmosphere passes over the heating elements 18 and is thus warmed. As the atmosphere is continuously being circulated and entrained beneath lower plate 50 the desired temperature of the atmosphere is maintained throughout the incubator space.

Should it be desired to humidify the atmosphere the control lever is attached to butterfly valve 90 at hinge 92 may be rotated in a anti-clockwise direction to cause the required proportion of atmosphere leaving that end of the space from above the heaters 18 to pass beneath the butterfly valve and into the water reservoir before proceeding upwardly into the canopy and occupant space. The butterfly valve 90 is shown in an intermediate position in FIG. 2. When the atmosphere is sufficiently humidified the butterfly valve is rotated in a clockwise direction until it rests on surface 16. The warmed atmosphere is then directed upwardly into the canopy, by-passing the water reservoir.

A desired amount of leakage of atmosphere through the covers of iris ports and access ports in the canopy also between the canopy and the base is counteracted by make up of atmosphere through the introduction of oxygen/air through mixing device 44.

The claims defining the invention are as follows:

1. An infant incubator comprising a plurality of wall panels, a patient support tray cooperating with at least some of said wall panels to form an occupant compartment having said patient support tray as the floor thereof, a plate disposed beneath said support tray and cooperating with said support tray and at least some of said wall panels to define a return flow path for taking atmosphere from said compartment, substantially the entire undersurface of said support tray and substantially the entire upper surface of said plate forming boundaries of said return flow-path, a base beneath said plate and having a floor directed towards said plate, said base cooperating with said plate and at least some of said wall panels to define an atmosphere delivery path communicating with said return flow path, substantially the entire undersurface of said plate and substantially the entire floor of said base forming boundaries of said delivery path, said base and at least some of said wall panels cooperating to provide a housing for said incubator, impeller means to withdraw atmosphere from said compartment through said return flow path for delivery along said delivery path back to said compartment, low temperature, high surface area heater means distributed over a major portion of said base floor in heat transfer relationship to atmosphere proceeding to said compartment, and means for adding make-up atmosphere to the atmosphere proceeding to said compartment.

2. An infant incubator as claimed in claim 1 wherein the floor of said compartment is substantially rectangular and includes side apertures extending above the opposite longitudinal sides thereof and end apertures extending along the opposite transverse end edges thereof, and wherein said return flow path communicates with said side apertures to draw atmosphere from said compartment through said side apertures, and wherein said delivery path communicates with said end apertures to deliver atmosphere to said compartment through said end apertures.

3. An infant incubator as claimed in claim 2 wherein said base includes a central wall, a pair of wells separated by said central wall and means defining an atmosphere flow passage interconnecting said pair of wells and extending through said central wall, each said well being of substantially equal size and forming part of said atmosphere delivery path, said passage also communicating with said return flow path.

4. An infant incubator as claimed in claim 3 wherein said impeller means is located within said atmosphere flow passage.

5. An infant incubator as claimed in claim 4 wherein said impeller comprises a rotary fan rotatable about a vertical axis and a drive motor located beneath said base to drive said impeller.

6. An infant incubator as claimed in claim 5 wherein said fan and said drive motor includes magnetic coupling means for coupling said fan to said drive motor such that no drive shaft extends from said drive motor to said fan through said base.

7. An infant incubator as claimed in claim 3 further comprising humidification means communicating with at least one of said wells.

8. An infant incubator as claimed in claim 7 wherein said humidification means comprises a water reservoir and valve means for directing a required proportion of atmosphere from said well over the surface of water within said reservoir.

9. An infant incubator as claimed in claim 3 wherein said means for adding make-up atmosphere includes an outlet port in communication with said atmosphere flow passage such that said make-up atmosphere is added to the atmosphere proceding through said atmosphere flow passage.

10. An infant incubator as claimed in claim 3 wherein said plate rests upon said central wall and includes an aperture providing communication between said atmosphere flow passage and the upper surface of said plate.

11. An infant incubator as claimed in claim 3 wherein said tray includes an inverted U-shaped channel extending downwardly from the underside thereof and partly across the width of said tray, said channel supporting the central region of said tray above said central wall and defining that part of said atmosphere return flow path communicating with said atmosphere flow passage.

12. An infant incubator as claimed in claim 11 wherein said plate rests upon said central wall and includes a central aperture providing communication between said atmosphere flow passage and the upper surface of said plate, and wherein said tray and plate are substantially rectangular and atmosphere from said compartment enters said return flow path through two return ducts defined in part by opposite longitudinal edges of said tray, said atmosphere then flowing through the space between said tray and plate, then through said channel and into said atmosphere flow passage, then away from said central wall through the space between said plate and the walls of each said well, then into said compartment through delivery ducts at opposite transverse edges of said plate.

* * * * *